US006634190B2

(12) United States Patent
Didier-Laurent

(10) Patent No.: US 6,634,190 B2
(45) Date of Patent: Oct. 21, 2003

(54) DOUBLE-FACED THICK KNITTED FABRIC WITH FLEXIBLE STRUCTURE

(75) Inventor: Christian Didier-Laurent, Remiremont (FR)

(73) Assignee: Ames Europe, Remiremont Cedex (FR)

( * ) Notice: Subject to any disclaimer, the term of this patent is extended or adjusted under 35 U.S.C. 154(b) by 0 days.

(21) Appl. No.: 10/111,577

(22) PCT Filed: Mar. 15, 2001

(86) PCT No.: PCT/FR01/00760

§ 371 (c)(1),
(2), (4) Date: Apr. 26, 2002

(87) PCT Pub. No.: WO01/68963

PCT Pub. Date: Sep. 20, 2001

(65) Prior Publication Data

US 2002/0152776 A1 Oct. 24, 2002

(30) Foreign Application Priority Data

Mar. 15, 2000 (FR) ..... 00 03277

(51) Int. Cl.[7] ..... D04B 7/04
(52) U.S. Cl. ..... 66/196; 66/193
(58) Field of Search ..... 66/196, 193, 195, 66/202, 8; 442/318

(56) References Cited

U.S. PATENT DOCUMENTS

| | | | | | |
|---|---|---|---|---|---|
| 5,385,036 | A | * | 1/1995 | Spillane et al. | 66/87 |
| 5,422,153 | A | * | 6/1995 | Miyamoto | 66/196 |
| 5,651,847 | A | * | 7/1997 | Loeffler | 66/19 |
| 5,735,145 | A | * | 4/1998 | Pernick | 66/196 |
| 6,105,401 | A | * | 8/2000 | Chadeyron et al. | 66/195 |

FOREIGN PATENT DOCUMENTS

| | | |
|---|---|---|
| DE | 9016062 | 2/1991 |
| EP | 0610845 | 8/1994 |
| EP | 0921221 | 6/1999 |
| WO | WO/9746749 | 12/1997 |

* cited by examiner

*Primary Examiner*—Danny Worrell
(74) *Attorney, Agent, or Firm*—Gary M. Cohen

(57) ABSTRACT

A thick double-face knitted fabric has a front face (1) and a rear face (2), which are connected to one another by an intermediate layer (3), and is produced on a circular knitting machine. The intermediate layer (3) is produced solely from binding monofilaments. The knitted fabric which is produced has the qualities of flexibility and of elasticity, and a minimum thickness of 3mm. A knitting method and a machine for producing the knitted fabric are also disclosed.

16 Claims, 1 Drawing Sheet

DOUBLE-FACED THICK KNITTED FABRIC WITH FLEXIBLE STRUCTURE

BACKGROUND OF THE INVENTION

The present invention relates to a novel method for the production of a thick double-face knitted fabric having an intermediate spacing structure, to a knitting machine of the tucked-stitch circular type for carrying out this method and to the knitted fabric obtained by this method.

A known thick knitted fabric of this general type is described in European Patent No. 0 610 845. The spacing threads of the disclosed thick knitted fabric are either multifilament threads or a combination of multifilament threads and monofilament threads which bind or stitch a row of one face together with the opposite row of the other face. The multifilament threads previously undergo a false twist during knitting, which is said to be indispensable for implementation of the disclosed thick knitted fabric.

Also known is to produce thick double-face knitted fabrics having an intermediate spacing structure on flat-bed knitting machines. Such knitted fabrics are disclosed, for example, in U.S. Pat. No. 5,385,036.

Such knitted fabrics have high crushing resistance. However, such knitted fabrics have the disadvantage of lacking flexibility and, primarily for this reason, are reserved for industrial uses which do not present a need for comfort.

Moreover, such knitted fabrics are given their properties by virtue of the relative inclination of the binding threads in relation to the two faces. This is due to the fact that two binding threads of two different rows are assembled on one and the same stitch or on two stitches of the same row of one face, thus giving the binding structure a pyramidal shape.

To the contrary, the present invention has as its object to provide a knitted fabric which is very thick, at least twice as thick as prior knitted fabrics of this general type, and which is at the same time flexible and comfortable, with a high elasticity and which is capable of resuming its initial thickness after prolonged and/or repeated crushings (for example, on vehicle seats).

SUMMARY OF THE INVENTION

These objects are achieved by a knitting method for the production of a thick double-face knitted fabric with a front face and a rear face in which the two faces are connected to one another by an intermediate layer. The method of the present invention is carried out according to what is generally known as a "tucked-stitch" technique, on a circular knitting machine, and the intermediate layer is produced solely with a binding monofilament.

Such a method produces a thick double-face knitted fabric with a front face and a rear face which are connected to one another by an intermediate layer. The knitted fabric is produced according to what is generally known as a "tucked-stitch" technique, on a circular knitting machine. The knitted fabric has an intermediate layer which is produced solely from binding monofilaments, and a thickness at least twice that of conventional knitted fabrics.

Preferably, the monofilament bonds bind to one another a row of stitches of one face and a row of stitches of the other face, so that the two rows are racked in relation to one another in the knitting direction. As a result, two binding threads of two different rows are always bound with different stitches and/or to different rows.

Further in accordance with the present invention, the intermediate layer can be connected to the front face and to the rear face by one of the known and generally available binding techniques, examples including binding by stitch, binding by load, and binding by stitch and by load.

The present invention also relates to a knitted fabric having a special texture of the binding layer, including a method and a machine for producing such a knitted fabric.

For a further understanding of the present invention, reference is made to the description which follows, together with the following illustrations.

DETAILED DESCRIPTION OF THE INVENTION

Figure 1:
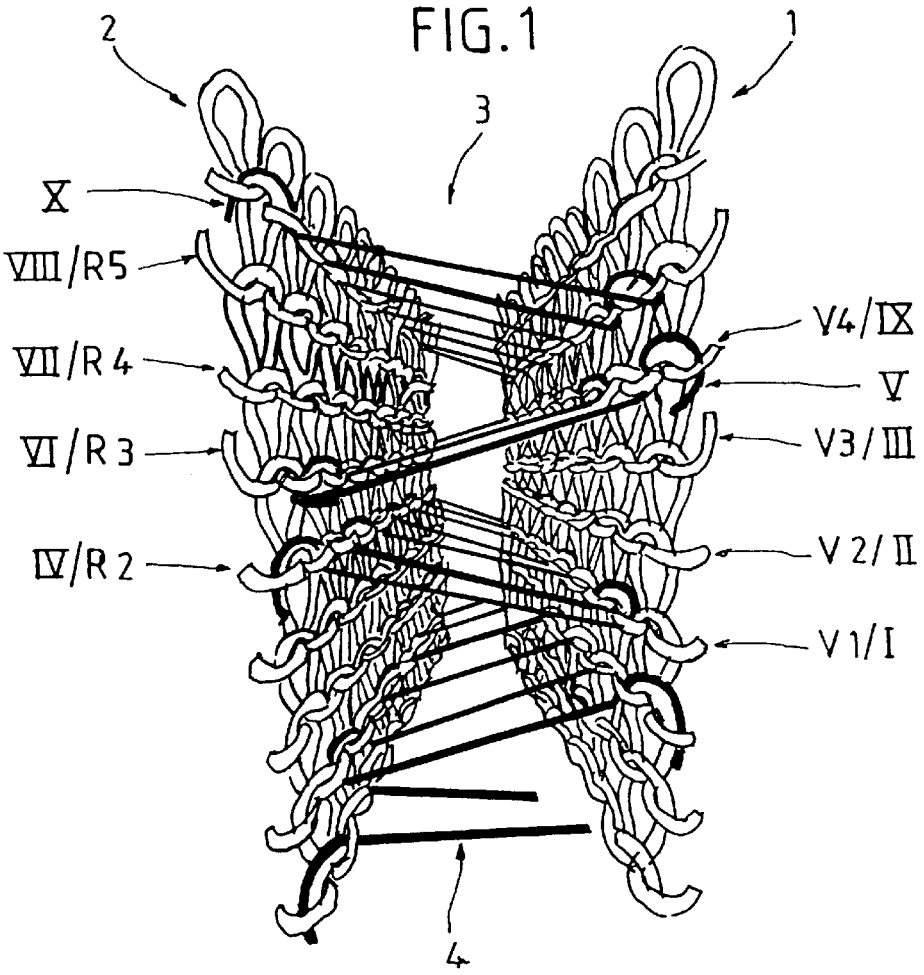
FIG. 1 shows a three-dimensional, illustrative example of a knitted structure produced in accordance with the present invention.

The knitted fabric shown in FIG. 1 is produced on a knitting machine of the "tucked-stitch" circular type, which produces a front face (1), a rear face (2) and an intermediate layer (3) connecting the front face (1) and the rear face (2) by a monofilament thread (4).

Figure 2:
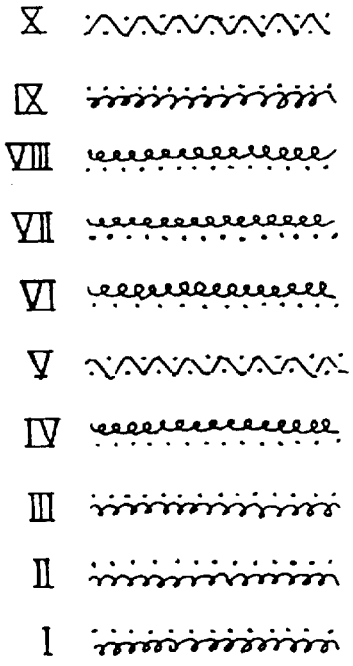
FIG. 2 shows a diagrammatic illustration of the steps of the knitting method for producing the knitted fabric shown in FIG. 1.

FIGS. 1 and 2 illustrate a method for knitting the fabric shown in FIG. 1. A cycle of 10 picks, designated by the references (I) to (X), are bound together with the rows ($V_0$) to ($V_7$) and ($R_0$) to ($R_7$) of the front face (1) and the rear face (2) of the knitted fabric shown in FIG. 1, respectively, as follows:

- picks (I), (II), (III); execution of the rows ($V_1$), ($v_2$), ($V_3$) of the front face,
- pick (IV); execution of the row ($R_2$) of the rear face,
- pick (V); binding between the rows ($V_3$) and ($R_2$) of the front and rear faces, respectively, by a monofilament,
- picks (VI), (VII), (VIII); execution of the rows ($R_3$), ($R_4$), ($R_5$) of the rear face,
- pick (IX); execution of the row ($V_4$) of the front face, and
- pick (X); binding of the rows ($R_5$) and ($V_4$) by a monofilament.

By virtue of the inclination of the binding monofilaments, the knitted fabric acquires high stability and high elasticity, resistance to sagging and to lateral slip, and a capacity for resuming its initial thickness after prolonged and/or repeated crushings.

The texture which has previously been described and the method for obtaining such a texture have been given by way of example, since other textures are also possible. Furthermore, while the binding technique used in the foregoing example is what is known as a load technique, what is known as a stitch technique, or a combination of these two techniques, could also be used.

To effectively distribute the properties of the knitted fabric in all directions, parallel to the two faces, it is necessary to prevent two different binding threads from being assembled on the same stitch, which is characteristic of previously known, rigid knitted fabrics. For this purpose, in practicing the knitting method of the present invention, it is preferable that two binding threads of two different rows are always bound to different stitches of the same row and/or to different rows, in such a way that two rows are always racked in relation to one another in the knitting direction.

Figure 3:
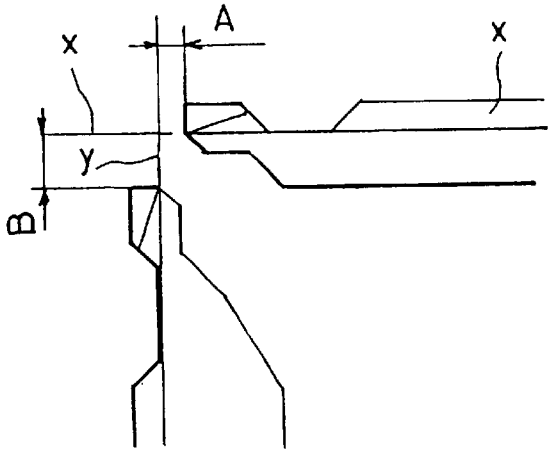
FIG. 3 shows a diagrammatic illustration of the knitting sections of a machine for performing the knitting method of the present invention.

To obtain the knitted fabric of the present invention, it is not possible to use standard circular machines, which in any case are more difficult to modify than flat-bed machines. Referring to FIG. 3, reorganizations have been necessary mainly in the region of the set of perpendicular knitting sections (X, Y), on which the setting is at least double the known standard setting, and preferably three to four times the standard setting. For a standard setting, the adjustment (B) in the direction (Y) is 0.5 to 1.5 times the adjustment (A) in the direction (X). For a setting in accordance with the present invention, the value of the adjustments (A) in the direction (X) and/or (B) in the direction (Y) are 3 to 4 times the values of the standard adjustments. With a setting in accordance with the present invention, knitted fabrics having a minimum thickness of 3 mm are obtained.

What is claimed is:

1. A knitting method for producing a thick double-face knitted fabric including a front face and a rear face, wherein the front face and the rear face are connected to one another by an intermediate layer, and wherein the method comprises the steps of:

knitting the fabric using a tucked-stitch technique on a circular knitting machine; and producing the intermediate layer solely with a binding monofilament.

2. The knitting method of claim 1 which further includes the step of successively executing a series of ten picks on a tucked-stitch circular knitting machine, wherein the series of ten picks are bound together with a series of rows ($V_0$) through ($V_7$) of the front face and a series of rows ($R_0$) through ($R_7$) of the rear face, and wherein the series of ten picks includes:

executing rows ($V_1$), ($V_2$) and ($V_3$) of the front face in a first pick, a second pick and a third pick, respectively;

executing a row ($R_2$) of the rear face in a fourth pick;

binding row ($V_3$) of the front face and row ($R_2$) of the rear face with a monofilament in a fifth pick;

executing rows ($R_3$), ($R_4$) and ($R_5$) of the rear face in a sixth pick, a seventh pick and an eighth pick, respectively;

executing row ($V_4$) of the front face in a ninth pick; and binding a row ($R_5$) of the rear face and a row ($V_4$) of the front face with a monofilament in a tenth pick.

3. The knitting method of claim 1 which further includes the step of binding two binding threads of two different rows to different stitches.

4. The knitting method of claim 1 which further includes the step of binding two different rows to another two different rows.

5. The knitting method of claim 1 which further includes the step of connecting the intermediate layer to the front face and to the rear face using a binding technique selected from the group of binding techniques consisting of binding by stitch, binding by load, and binding by stitch and by load.

6. The knitting method of claim 1 wherein knitting sections on the tucked-stitch circular knitting machine have a vertical offset and a horizontal offset, and a standard setting for the vertical offset which is from 0.5 to 1.5 times the horizontal offset, and which further includes the step of operating the knitting sections on the tucked-stitch circular knitting machine at an operative setting which is at least double the standard setting.

7. The knitting method of claim 6 wherein the operative setting is from three to four times the standard setting.

8. A circular knitting machine for producing, using a tucked-stitch technique, a thick double-face knitted fabric including a front face and a rear face, wherein the front face and the rear face are connected to one another by an intermediate layer, wherein the intermediate layer is produced solely with a binding monofilament, and wherein the circular knitting machine comprises:

a set of perpendicular knitting sections having a vertical offset and a horizontal offset, wherein a standard setting for the vertical offset is from 0.5 to 1.5 times the horizontal offset, and wherein an operative setting for the perpendicular knitting sections is at least double the standard setting.

9. The circular knitting machine of claim 8 wherein the operative setting is from three to four times the standard setting.

10. A thick double-face knitted fabric having a front face and a rear face which are connected to one another by an intermediate layer, wherein the knitted fabric is a tucked-stitch fabric, wherein the tucked-stitch fabric is produced on a circular knitting machine, and wherein the intermediate layer is bound solely with a binding monofilament.

11. The thick double-face knitted fabric of claim 10 wherein the knitted fabric has a knitting direction, wherein the monofilament bonds bind to one another a first row of stitches of a first face and a second row of stitches of a second face, and wherein the first row and the second row are racked in relation to one another in the knitting direction.

12. The thick double-face knitted fabric of claim 10 having a minimum thickness of 3 mm.

13. The thick double-face knitted fabric of claim 10 wherein the knitted fabric includes a successive series of ten picks bound together with a series of rows ($V_0$) through ($v_7$) of the front face and a series of rows ($R_0$) through ($R_7$) of the rear face, including:

first, second and third picks executed on rows ($V_1$), ($V_2$) and ($V_3$) of the front face;

a fourth pick executed on a row ($R_2$) of the rear face;

a fifth pick binding a row ($V_3$) of the front face and a row ($R_2$) of the rear face with a monofilament;

sixth, seventh and eighth picks executed on rows ($R_3$), ($R_4$) and ($R_5$) of the rear face;

a ninth pick executed on a row ($V_4$) of the front face; and a tenth pick binding a row ($R_5$) of the rear face and a row ($V_4$) of the front face with a monofilament.

14. The thick double-face knitted fabric of claim 10 wherein two binding threads of two different rows are bound to different stitches.

15. The thick double-face knitted fabric of claim 10 wherein two different rows are bound to another two different rows.

16. The thick double-face knitted fabric of claim 10 wherein the intermediate layer is connected to the front face and to the rear face by a binding technique selected from the group of binding techniques consisting of binding by stitch, binding by load, and binding by stitch and by load.

* * * * *